US006603384B1

(12) United States Patent
Kremers et al.

(10) Patent No.: US 6,603,384 B1
(45) Date of Patent: Aug. 5, 2003

(54) SELF-RECOVERING CURRENT-LIMITING DEVICE HAVING LIQUID METAL

(75) Inventors: Wolfgang Kremers, Bonn (DE); Frank Berger, Swisttal-Miel (DE); Andreas Kraetzschmar, Bonn (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/009,719

(22) PCT Filed: May 16, 2000

(86) PCT No.: PCT/EP00/04818

§ 371 (c)(1),
(2), (4) Date: Dec. 13, 2001

(87) PCT Pub. No.: WO00/77811

PCT Pub. Date: Dec. 21, 2000

(30) Foreign Application Priority Data

Jun. 15, 1999 (DE) ..... 199 27 065

(51) Int. Cl.[7] ..... H01H 87/00; H01H 29/02

(52) U.S. Cl. ..... 337/21; 337/119; 337/121; 337/122; 337/167; 335/49; 335/50; 335/51; 335/57

(58) Field of Search ..... 337/21, 114, 119, 337/121, 122, 167; 335/47, 49, 50, 51, 57; 200/32, 81.6, 152; 361/58; 439/88, 181; 29/622

(56) References Cited

U.S. PATENT DOCUMENTS

| | | | | | |
|---|---|---|---|---|---|
| 1,595,061 | A | * | 8/1926 | Valerius | 337/119 |
| 3,249,722 | A | * | 5/1966 | Lindberg, Jr. | 337/21 |
| 3,331,937 | A | * | 7/1967 | Harvey | 200/209 |
| 3,381,248 | A | * | 4/1968 | Furth | 335/51 |
| 3,389,359 | A | * | 6/1968 | Harris | 337/114 |
| 3,389,360 | A | * | 6/1968 | Keenan | 337/114 |
| 3,699,489 | A | * | 10/1972 | Imajyo | 337/21 |
| 3,838,373 | A | * | 9/1974 | Inoue et al. | 337/21 |
| 4,429,295 | A | * | 1/1984 | Wu | 337/119 |
| 4,510,356 | A | * | 4/1985 | Malm | 200/48 R |
| 5,471,185 | A | * | 11/1995 | Shea et al. | 335/51 |
| 5,581,192 | A | * | 12/1996 | Shea et al. | 324/722 |

FOREIGN PATENT DOCUMENTS

| | | | | |
|---|---|---|---|---|
| DE | 2652506 | | 5/1978 | |
| DE | 3132087 | A1 * | 8/1982 | H01H/29/00 |
| DE | 4012385 | | 3/1991 | |
| GB | 2036443 | A * | 6/1980 | H01H/1/06 |
| SU | 922911 | A | 4/1982 | |
| SU | 1076981 | | 2/1984 | |

* cited by examiner

*Primary Examiner*—Anatoly Vortman
(74) *Attorney, Agent, or Firm*—Davidson, Davidson & Kappel, LLC

(57) ABSTRACT

A self-recovering current-limiting device having liquid metal includes solid metal electrodes for connecting to an external electric circuit to be protected. A plurality of compression spaces which are partially filled with liquid metal are arranged one behind the other between the electrodes and are formed by pressure-resistant insulating bodies and by insulating partitioning walls having connecting channels. An enclosing insulating shaped housing is provided having a trough-like bottom part and a cover that tightly closes the bottom part via a non-positive and/or positive connecting device. The partitioning walls and the bottom part are interconnected as one piece. The connecting channels are configured as longitudinal holes which are open at the top. The electrodes are mounted in the bottom part. The nominal current range of the device may be easily adjusted.

20 Claims, 6 Drawing Sheets

SELF-RECOVERING CURRENT-LIMITING DEVICE HAVING LIQUID METAL

BACKGROUND

The present invention relates to a self-recovering current-limiting device with liquid metal, including electrodes made of solid metal for the connection to an external electric circuit to be protected and several compression spaces which are partially filled with liquid metal.

Soviet Union Patent Publication SU 922 911 A describes a single-pole, self-recovering current-limiting device containing two electrodes made of solid metal which are separated by first insulating bodies which are designed as a pressure-resistant insulating housing. Inside the insulating housing, compression spaces are formed by insulating intermediate walls and second insulating bodies which are arranged therebetween and designed as ring-shaped sealing disks, the compression spaces being partially filled with liquid metal and arranged one behind the other and interconnected via circular connecting channels of the intermediate walls, the connecting channels being filled with liquid metal and arranged off-center. Thus, in normal operation, a continuous, inner conductive connection exists between the electrodes via the liquid metal. In the current-limiting event, the liquid metal is displaced from the connecting channels as a result of the high current density. In this manner, the electrical connection of the electrodes via the liquid metal is interrupted, resulting in the limiting of the short-circuit current. Subsequent to clearing or eliminating the short circuit, the connecting channels refill with liquid metal whereupon the current-limiting device is operational again. The intermediate walls must resist the pressure rise during the vaporization of liquid metal and are composed of high-quality ceramic material having a high temperature resistance and a high erosion resistance to the action of electric arcs. In German Patent Application DE 40 12 385 A1, a current-limiting device having only one compression space is described, and vacuum, protective gas, or an insulating liquid are mentioned as the medium above the liquid level. According to Soviet Union Patent Publication SU 1 076 981 A, the connecting channels of adjacent intermediate walls are staggered relative to each other for improving the limiting characteristics. It is known from German Patent Application DE 26 52 506 A1 to use gallium alloys, in particular GaInSn alloys in contact devices.

The known current-limiting devices are equipped with current-conducting connecting channels of circular cross-section. The once selected, non-changeable opening cross-section of the connecting channels substantially determines the nominal current carrying capacity of the current-limiting device. Consequently, an ex-works current-limiting device is only suitable for just one nominal current range. On the user side, there is no possibility to adapt the current-limiting device to a higher or lower nominal current range. In the known current-limiting devices, moreover, problems occur at the sealing joints between the joined insulating bodies. The ability to creep of liquid metals places high demands on the tightness of the current-limiting devices. Moreover, the known current-limiting devices have the feature of a component-intensive design and considerable assembly effort.

SUMMARY OF THE INVENTION

Therefore, an object of the present invention is to provide a self-recovering current-limiting device having liquid metal, the device being relatively inexpensive to manufacture and relatively simply adjustable to a desired nominal current range.

The present invention provides a self-recovering current-limiting device including a liquid metal. The device includes a first and a second electrode for connection to an electric circuit to be protected, each of the first and second electrodes being made of a respective solid metal. A plurality of pressure-resistant insulating bodies and a plurality of insulating intermediate walls are provided. The plurality of insulating intermediate walls and the plurality of pressure-resistant insulating bodies define a plurality of first compression spaces, the plurality of first compression spaces being disposed one behind the other between the first and second electrodes and being at least partially filled with the liquid metal. The plurality of insulating intermediate walls define a plurality of connecting channels as upwardly open slotted holes, the plurality of insulating intermediate walls being integrally connected to the bottom part. A cover is provided configured for tightly closing the bottom part using at least one of a nonpositive-locking and positive-locking connecting device, the cover and the bottom part forming a housing.

The current-limiting device according to the present invention needs only few components, namely two electrodes, a two-part molded housing serving as an insulating body as well as connecting devices, which are known per se, such as screw, clamping, adhesive, welded or compression connections for connecting the bottom part and the cover. Because of this, the outlay in terms of the provision, assembly and sealing of the remaining parts is equally considerably reduced. The creeping of liquid metal no longer constitutes a problem. The cover and the bottom part, including the intermediate walls, are composed of heat-resistant material, for example, heat-resistant thermoplastic or thermosetting material, mica, or ceramics. The upwardly open connecting channels configured as slotted holes allow the bottom part to be easily removed from the mold. By filling in a certain amount of liquid metal, a certain partial cross-section of the filled connecting channels is determined as the current-conducting cross-section in the horizontal position of use of the current-limiting device, thereby determining the nominal current range. The nominal current carrying capacity increases with the filling height. The filling height can be determined, adapted or changed on the manufacturer or on the user side. This permits optimum adaptation to the conditions of the systems to be protected, involving a minimum number of sizes of a type series of current-limiting devices.

The alternatingly staggered arrangement of the connecting channels which are in each case assigned to one of the intermediate walls results in a current path in meander form and in an elongation of the electric arc in the current-limiting event.

It serves the mechanical stability if both the exterior walls and the intermediate walls are tightly connected to the cover, with the wall heights advantageously being identical. It is recommendable to use a sealing device which may include injection-molded or otherwise molded seal or seals.

To ensure that the bottom part can be easily removed from the mold, it is expedient for the relevant edges and wall surfaces to be slightly slanted.

In the case of connecting channels having the usual slotted hole shape, a linear dependency between the filling height of the liquid metal and the current-conducting cross-section exists. In contrast, this dependency is progressive in the case of a slotted hole shape that markedly widens upward in a conical manner, which can be used for markedly extending the nominal current ranges.

The electrodes can be supported in the bottom part in a simple manner using devices which are known per se and fixed by installing the cover. The assembly effort is reduced if the electrodes are fixed in the bottom part, preferably simultaneously with the molding process of the bottom part. A full-surface coverage of the relevant inner surfaces by the electrodes makes it easier for them to be fixed and serves the stability of the current-limiting device.

A reclosable filling opening at a suitable location of the molded housing allows the current-limiting device in a simple manner to be filled, decanted, or adapted to the required nominal current range with regard to its filling height on the factory or on the customer side. GaInSn alloys as the liquid metal to be used are easy to handle because of their physiological harmlessness. An alloy of 660 parts by weight of gallium, 205 parts by weight of indium, and 135 parts by weight of tin is liquid from 10° C. to 2000° C. at normal pressure and possesses sufficient electrical conductivity.

The current-limiting device described above as a single-pole device can advantageously be expanded by arranging substantially identical current-limiting devices side by side to form a multipole device. A multipole current-limiting device of that kind expediently possesses a common bottom part having conducting paths which are insulated against one another according to the number of poles and/or a common cover.

BRIEF DESCRIPTIONS OF THE DRAWINGS

Further details and advantages of the present invention will be explained below with reference to the drawings.

BEST WAY OF IMPLEMENTING THE INVENTION

Figure 1:
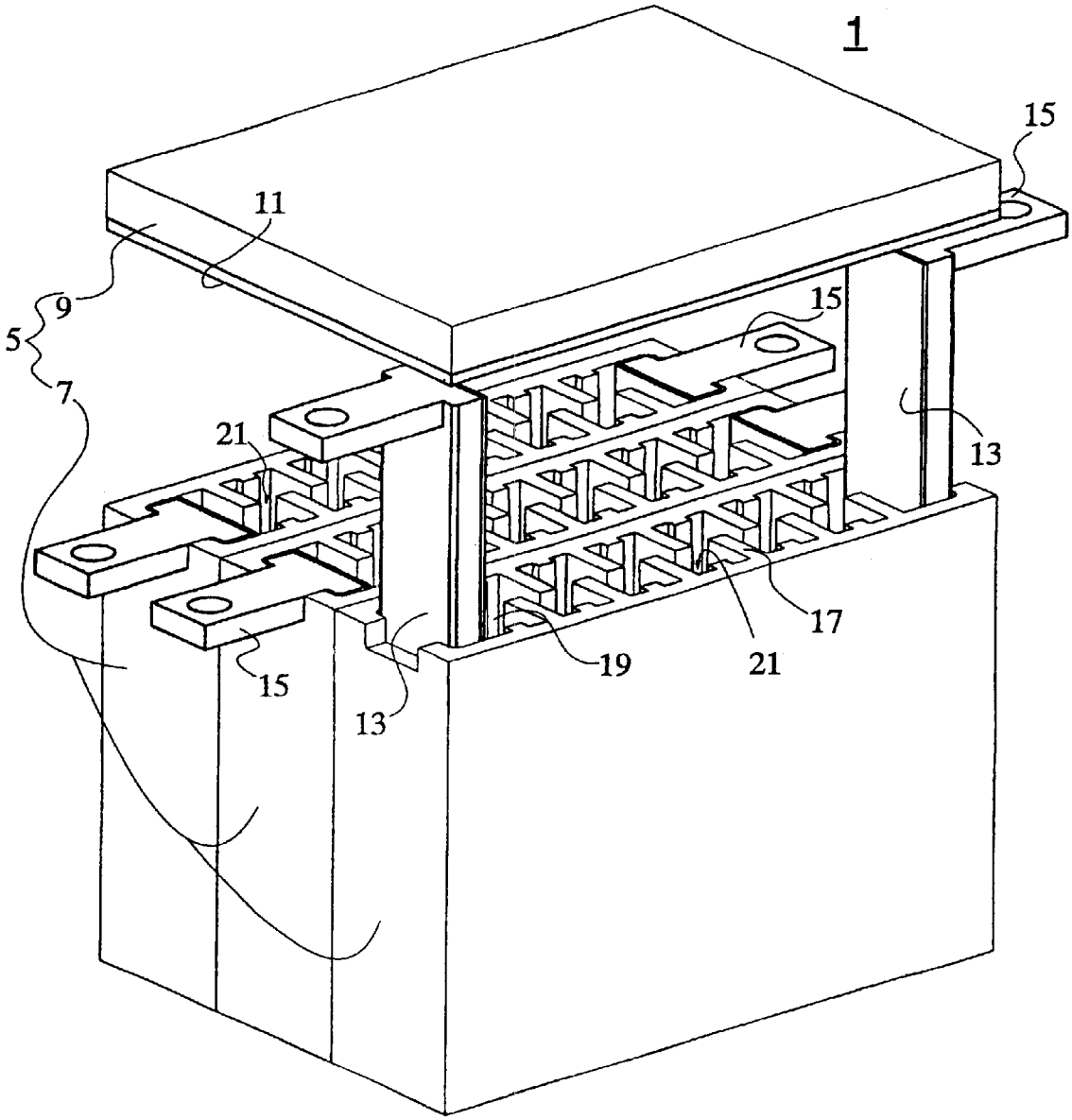
FIG. 1 shows a perspective, partially pulled-apart view of a current-limiting device according to the present invention.
Figure 2:
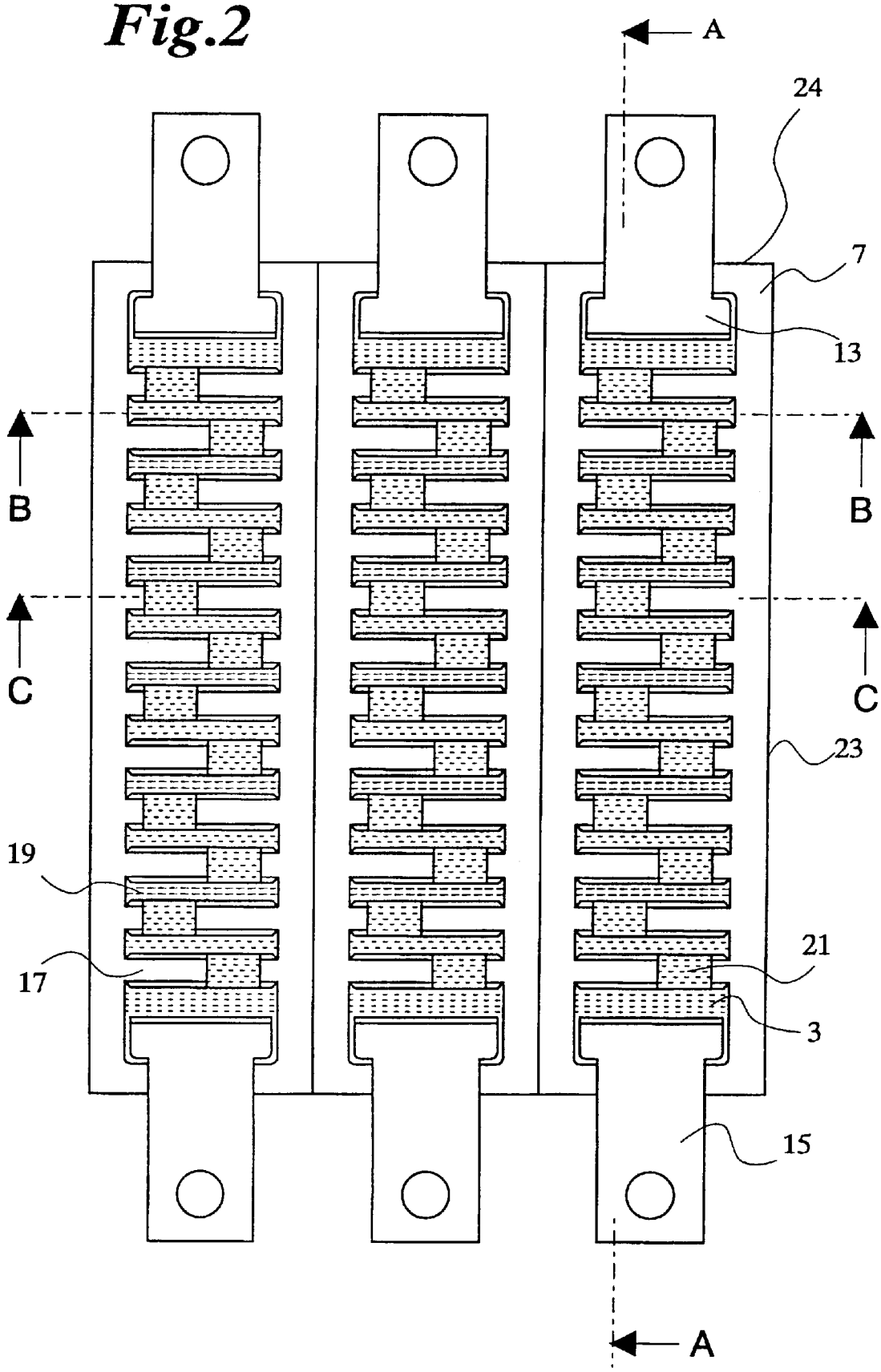
FIG. 2 is a top view of the current-limiting device according to FIG. 1 with removed cover.
Figure 3:
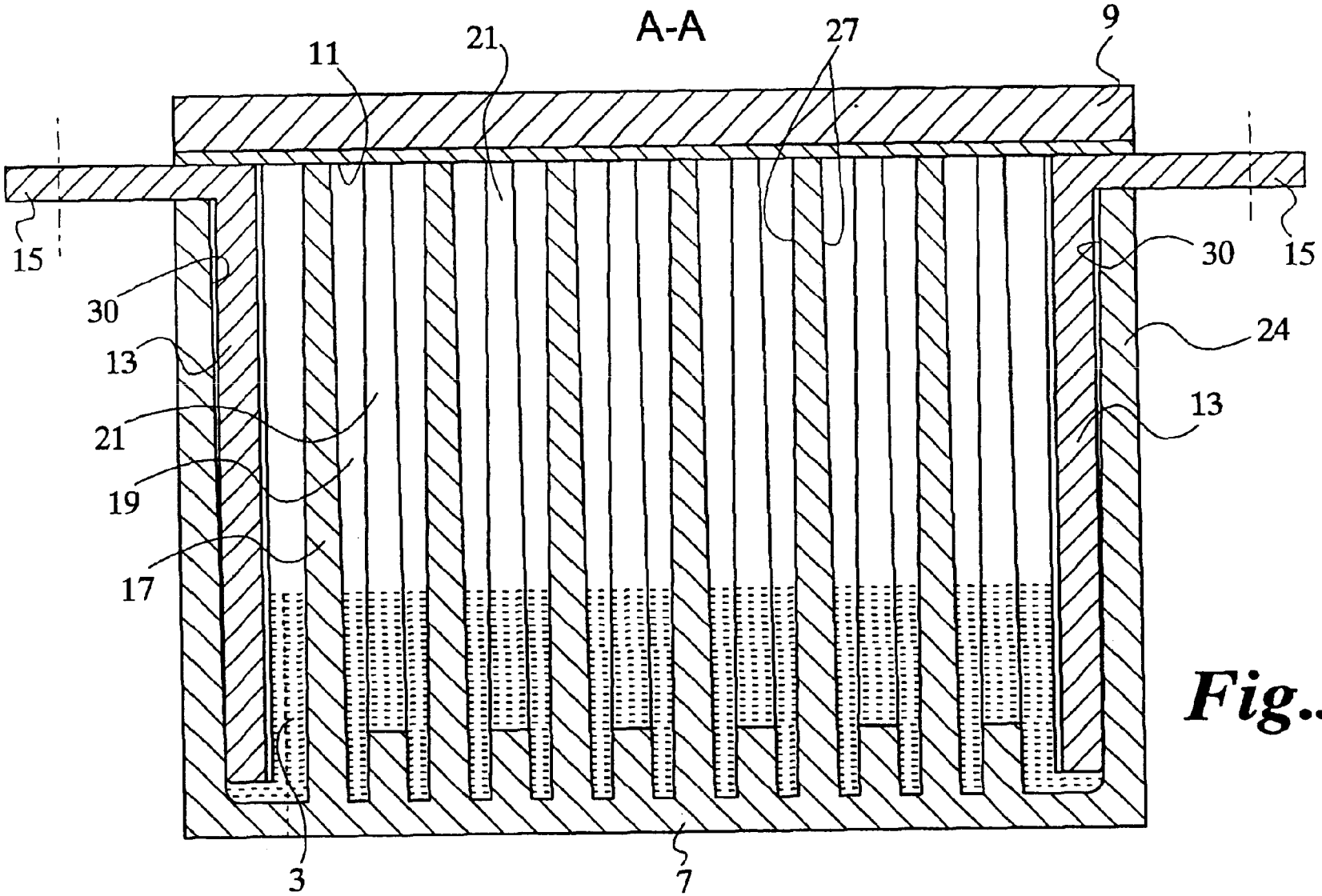
FIG. 3 depicts longitudinal section A—A according to FIG. 2.
Figure 4:
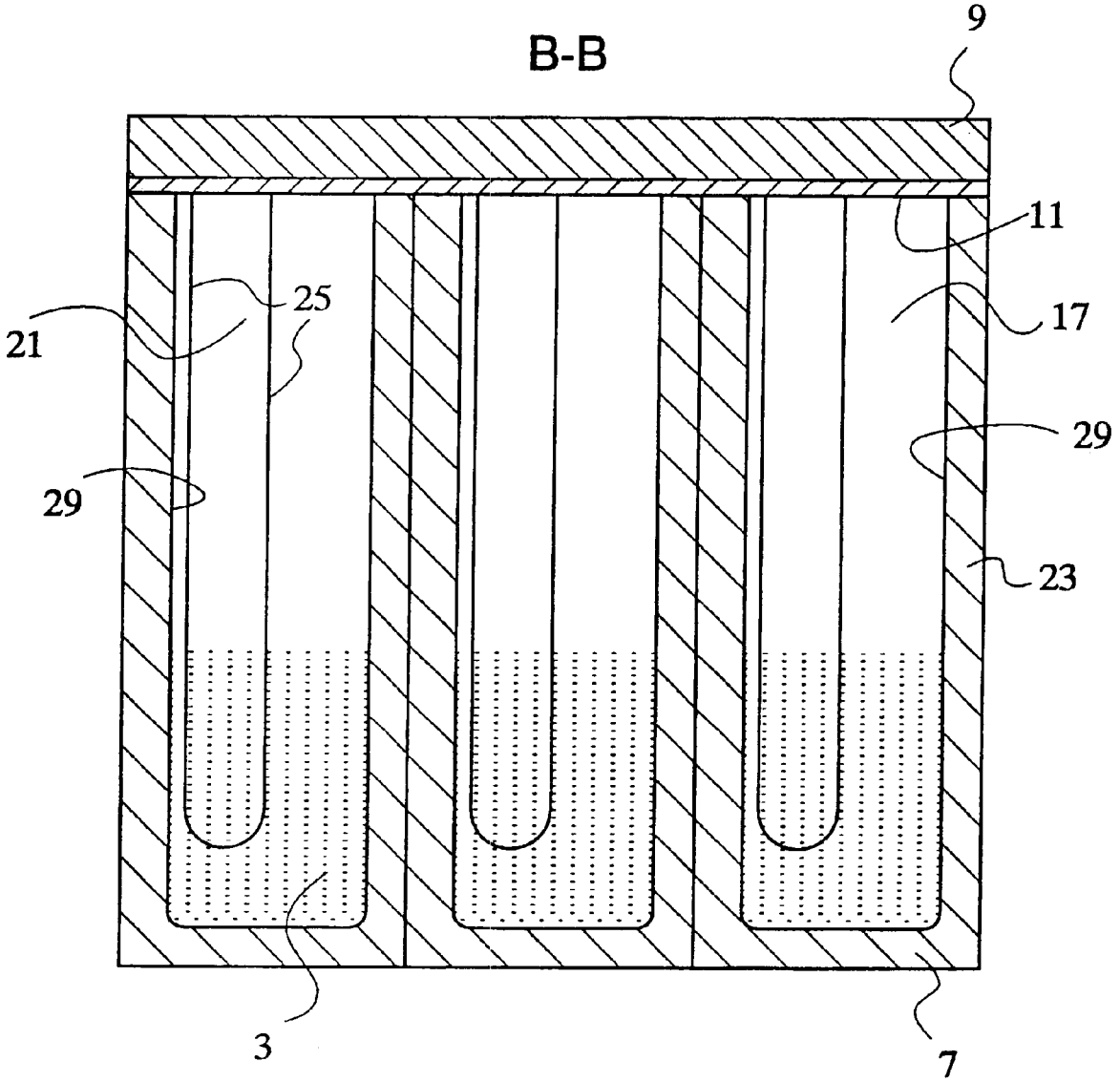
FIG. 4 shows cross-section B—B according to FIG. 2.
Figure 5:
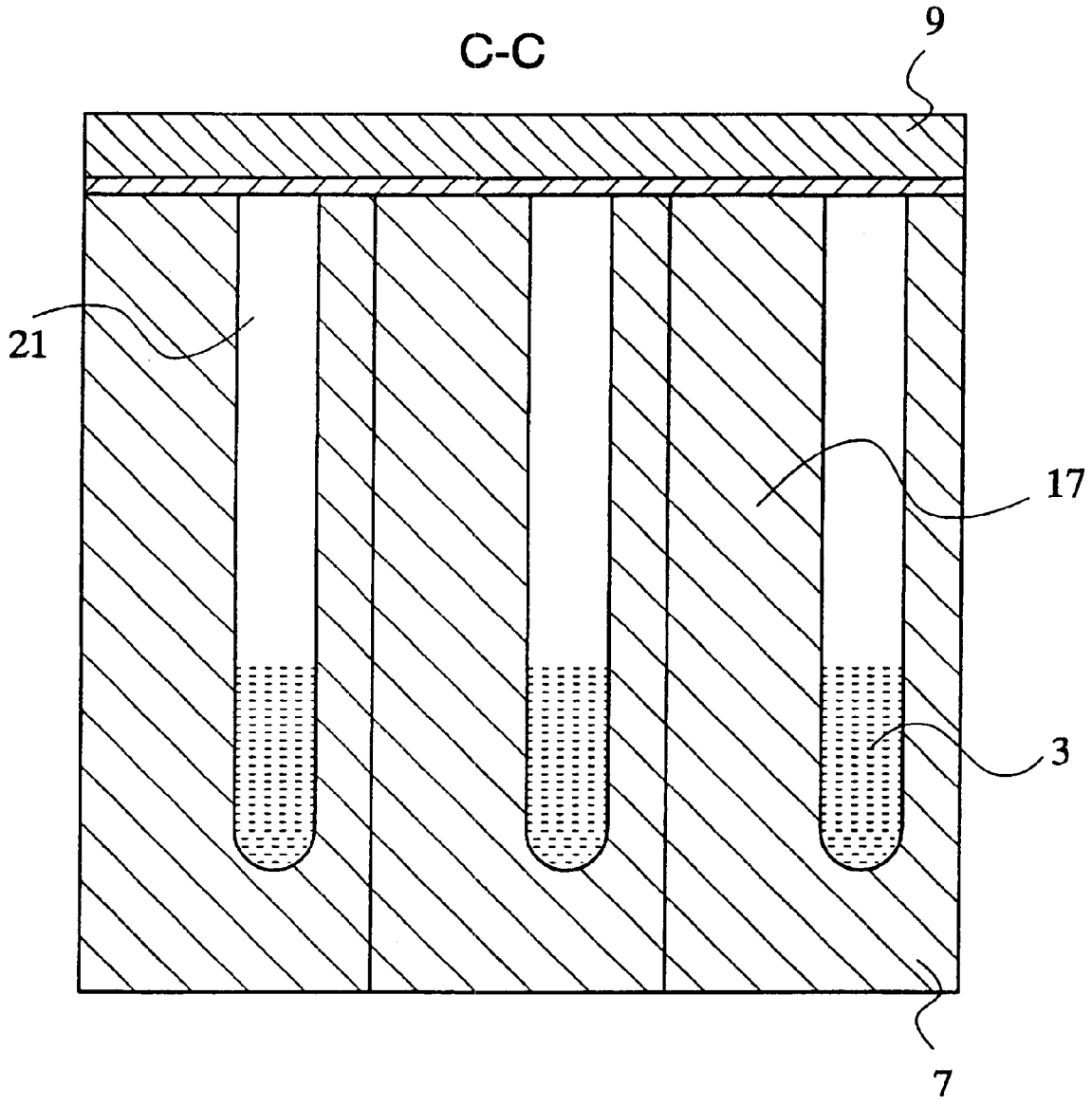
FIG. 5 represents cross-section C—C according to FIG. 2 which is offset with respect to the latter.

Self-recovering current-limiting device 1 with liquid metal 3 according to FIGS. 1 through 5 has a three-pole design and serves for protecting a three-phase system. Current-limiting device 1 is enclosed by an insulating body designed as a molded housing 5. Molded housing 5 is composed of three identical trough-like bottom parts 7 arranged closely side by side and of a common cover 9. In the assembled condition, bottom parts 7 are closed by cover 9 via a non-positive and/or positive locking connecting device such as an overlapping clamping device in the form of clamping bars, clamping bolts and clamping nuts; a sealing device 11 injection-molded onto the bottom side of cover 9 providing the required tightness of molded housing 5 toward the inside and outside. The connecting device is not shown for reasons of clarity. Two electrodes 13 made of copper are supported per pole in respective bottom part 7. For the connection to an external electric circuit to be protected, electrodes 13 are each provided with a connecting conductor 15 laterally protruding out of molded housing 5. Bottom parts 7 are divided into compression spaces 19 by transversely arranged intermediate walls 17. Intermediate walls 17 are formed in one piece with the respective bottom part 7. Formed in each intermediate wall 17 is a connecting channel 21 which is upwardly open when cover 9 is removed. Compression spaces 19, which are in each case arranged one behind the other in a bottom part 7, are filled with liquid metal 3, for example a GaInSn alloy, up to a certain height. Depending on the filling height of liquid metal 3, connecting channels 21 are likewise filled to a certain extent so that a continuous current path exists between electrodes 13 via liquid metal 3 in nominal current conditions. The cross-section filled by liquid metal 3 which is decisive for the nominal current range is determined by the filling height of liquid metal 3. Connecting channels 21 of adjacent intermediate walls 17 are staggered relative to each other so that a meander-shaped current path ensues. Bottom parts 7 feature external walls 23, 24 and intermediate walls 17 of equal height. Consequently, each bottom part 7 is tightly connected to cover 9 via its four external walls 23, 24 and via intermediate walls 17.

To allow bottom parts 7 to be easily removed from the mold subsequent to being shaped, intermediate walls 17 and external walls 23, 24 are configured appropriately. Accordingly, inner edges 25 of connecting channels 21 are slightly slanted outward and wall surfaces 27 of intermediate walls 17 are slightly slanted toward the interior of intermediate walls 17. Moreover, external walls 23 and 24 have inner surfaces 29 and 30, respectively, which are slightly slanted outward. Opposed inner surfaces 30 are completely covered by electrodes 13.

Figure 6:
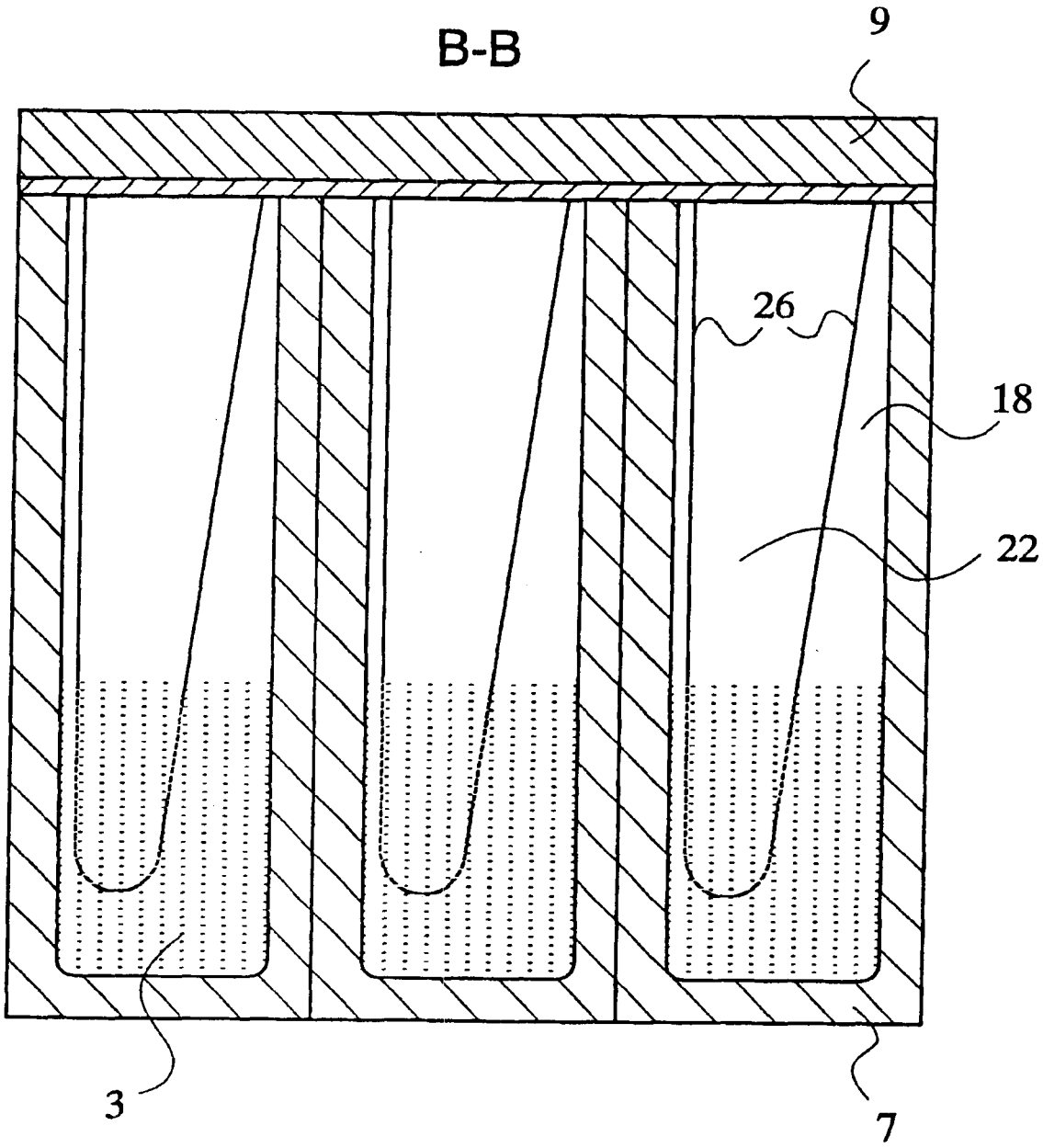
FIG. 6 depicts cross-section B—B according to FIG. 2 for a variant of an embodiment of the current-limiting device according to FIG. 1.

In the case of current-limiting device 1 described with the assistance of FIGS. 1 through 5, the filling height of liquid metal 3 and the cross-section of connecting channels 21 which is filled with liquid metal 3, i.e., conducting, are nearly linearly connected with each other. In the variant of an embodiment according to FIG. 6, provision is made for intermediate walls 18 whose inner edges 26 run relative to one another in such a manner that the resulting connecting channels 22 widen considerably toward their open end. Because of this, during an increase of the filling height of liquid metal 3, the conducting cross-section in connecting channels 22 increases more strongly than the rise of the filling height.

The present invention is not limited to the specific embodiments described above but is defined by the appended claims. Thus, for example, the present invention can be embodied in such a manner that during the molding of the bottom parts, the electrodes are molded thereinto at the same time. Moreover, the bottom parts can each be provided, preferably in the lower region, with a reclosable filling opening for the liquid metal via which it is likewise possible to add or remove additional or excess quantities of liquid metal, respectively.

What is claimed is:

1. A self-recovering current-limiting device including a liquid metal, the device comprising:

a first and a second electrode for connection to an electric circuit to be protected, each of the first and second electrodes being made of a respective solid metal;

a plurality of pressure-resistant insulating bodies, the plurality of insulating bodies defining a trough-like bottom part configured for supporting the first and second electrodes;

a plurality of insulating intermediate walls, the plurality of insulating intermediate walls and the plurality of pressure-resistant insulating bodies defining a plurality of first compression spaces, the plurality of first compression spaces being disposed one behind the other between the first and second electrodes and being at least partially filled with the liquid metal, the plurality of insulating intermediate walls defining a plurality of connecting channels as upwardly open slotted holes, the plurality of insulating intermediate walls being integrally connected to the bottom part; and a cover configured for tightly closing the bottom part using at least one of a nonpositive-locking and positive-locking connecting device, the cover and the bottom part forming a housing.

2. The self-recovering current-limiting device as recited in claim 1 wherein each of the plurality of insulating intermediate walls defines a respective one of the plurality of connecting channels and wherein the respective connecting channels defined by adjacent ones of the plurality of insulating intermediate walls are laterally staggered relative to each other.

3. The self-recovering current-limiting device as recited in claim 1 wherein the bottom part includes a plurality of external walls and is tightly connected to the cover using the external walls and the insulating intermediate walls.

4. The self-recovering current-limiting device as recited in claim 1 wherein the bottom part includes a plurality of external walls having a height the same as a height of the insulating intermediate walls.

5. The self-recovering current-limiting device as recited in claim 1 wherein the at least one of a nonpositive-locking and positive-locking connecting device includes a sealing device.

6. The self-recovering current-limiting device as recited in claim 1 wherein inner edges of the plurality of connecting channels are slanted outward.

7. The self-recovering current-limiting device as recited in claim 6 wherein the inner edges of the plurality of connecting channels are slanted outward slightly.

8. The self-recovering current-limiting device as recited in claim 6 wherein the inner edges of the plurality of connecting channels widen upward substantially.

9. The self-recovering current-limiting device as recited in claim 1 wherein wall surfaces of the plurality of connecting channels are slanted inward.

10. The self-recovering current-limiting device as recited in claim 9 wherein the wall surfaces of the plurality of connecting channels are slanted inward slightly.

11. The self-recovering current-limiting device as recited in claim 1 wherein the bottom part includes a plurality of external walls, inner surfaces of the plurality of external walls being slanted outward.

12. The self-recovering current-limiting device as recited in claim 11 wherein the inner surfaces of the plurality of external walls are slanted outward slightly.

13. The self-recovering current-limiting device as recited in claim 1 wherein the first and second electrodes are fixed in the bottom part and each include a respective outwardly-reaching connecting conductor.

14. The self-recovering current-limiting device as recited in claim 13 wherein the bottom part is molded around at least the respective connecting conductors.

15. The self-recovering current-limiting device as recited in claim 1 wherein the first and second electrodes cover respective opposite inner surfaces of the bottom part.

16. The self-recovering current-limiting device as recited in claim 1 wherein the housing defines a closable filling opening.

17. The self-recovering current-limiting device as recited in claim 1 wherein the liquid metal includes an alloy of GaInSn.

18. The self-recovering current-limiting as recited in claim 1 wherein the first and second electrode are associated with a first pole and further comprising a third and a fourth electrode associated with a second pole, the first and the second pole being substantially identical.

19. The self-recovering current-limiting device as recited in claim 1 wherein the first and second electrode are associated with a first pole and further comprising a third and a fourth electrode associated with a second pole, the first and the second pole being substantially identical, and wherein the bottom part is further configured for supporting the third and fourth electrodes.

20. The self-recovering current-limiting device as recited in claim 1 wherein the first and second electrode are associated with a first pole and further comprising a third and a fourth electrode associated with a second pole, the first and the second pole being substantially identical, and further comprising a second bottom part configured for supporting the third and fourth electrodes and wherein the cover is further configured for tightly closing the second bottom part.

* * * * *